US006923587B2

(12) United States Patent
Lee

(10) Patent No.: US 6,923,587 B2
(45) Date of Patent: Aug. 2, 2005

(54) GEL-FORM LIPSTICK

(76) Inventor: Jong Chul Lee, No. 308-607, Haan Jugong, Apartment 3-Development, 650, Haan-2-dong, Kwangmyung-si Kyungki-do (KR), 423-062

( * ) Notice: Subject to any disclaimer, the term of this patent is extended or adjusted under 35 U.S.C. 154(b) by 0 days.

(21) Appl. No.: 10/450,710

(22) PCT Filed: Dec. 7, 2001

(86) PCT No.: PCT/KR01/02114

§ 371 (c)(1),
(2), (4) Date: Jul. 22, 2004

(87) PCT Pub. No.: WO02/052979

PCT Pub. Date: Jul. 11, 2002

(65) Prior Publication Data

US 2004/0253035 A1 Dec. 16, 2004

(30) Foreign Application Priority Data

Dec. 30, 2000 (KR) ..... 20-2000-0037359

(51) Int. Cl.[7] ..... B43K 21/18

(52) U.S. Cl. ..... 401/66; 221/279

(58) Field of Search ..... 221/279, 266; 401/65, 66

(56) References Cited

U.S. PATENT DOCUMENTS 2,539,116 A * 1/1951 Brooks ..... 401/66
5,011,317 A * 4/1991 Gueret ..... 401/66
5,842,802 A 12/1998 Lang

* cited by examiner

*Primary Examiner*—Kenneth Noland
(74) *Attorney, Agent, or Firm*—Foley & Lardner LLP

(57) ABSTRACT

Disclosed herein is a gel-form lipstick dispenser which may discharge gel-form lipstick materials with very high viscosity safely.

1 Claim, 8 Drawing Sheets

PRIOR ART
Replacement Sheet
FIG. 2
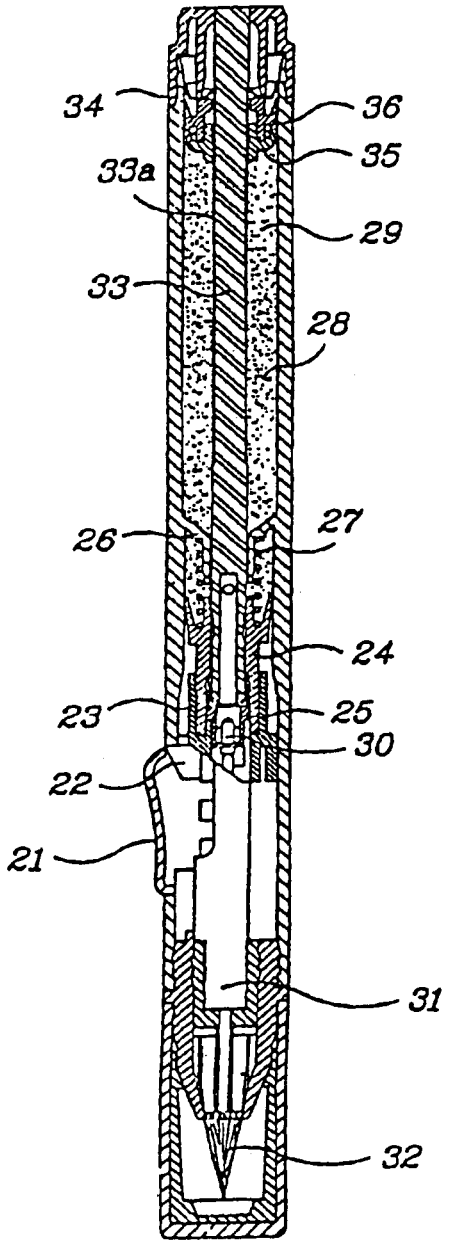

GEL-FORM LIPSTICK

FIELD OF THE INVENTION

The present invention relates to a gel-form lipstick dispenser and, more particularly, to a gel-form lipstick dispenser which may discharge gel-form lipstick materials safely, wherein a cylinder is displacement horizontally by being moved together with a pushing button provided in a dispenser body, and a first piston and a second piston are marched mechanically depending on a horizontal displacement of a ratchet bar coupled with the cylinder.

BACKGROUND OF THE INVENTION

As well known, the lipsticks usually used are solid-form one. However, in recent, liquid or gel-form lipsticks are proposed because solid-form lipsticks have several disadvantages. Conventional lipstick dispenser which may be used by filing it with liquid or gel-form lipstick materials are disclosed, for example, in Korean Utility Model Registration Publication Nos. 89-5413, 90-6221, 90-6963, 91-3018 and 91-3019 and Korean Utility Model Registration Application No. 98-13812.

However, conventional lipstick dispensers above-listed have a disadvantage commonly as follows. The liquid or gel-form materials filled in a dispenser must be discharged in constant amount by pushing the discharging button installed in the dispenser in order to use liquid or gel-form lipsticks. However, conventional inventions have disadvantage in that a dispensing button may not be easily pressed while lipstick is used because the discharging button is provided in rear part of the lipstick dispenser. Further, another conventional liquid or gel-form lipstick dispenser solving the aforementioned disadvantage has another disadvantage in that liquid or gel-form lipstick materials are not discharged smoothly by constant amount. Specially, the higher viscosity gel-form lipstick materials have, the greater problem it happens.

An embodiment of conventional liquid lipstick dispenser is shown in FIG. 1. In conventional lipstick dispenser shown in FIG. 1, when a pulley block (2) is forced by pushing a pushing plate (1), the pulley block (2) is retracted in horizontal direction then it pushes a piston rod (3) and a piston (4). At this time, a spring (5) is also compressed. The pressure in a transferring tube (6) is increased by movement of the piston (4), and the pressure makes a valve (8) be opened hereinafter gel-form lipstick materials (7) are discharged to a discharging opening (9).

Also, when the force pressing pushing plate (1) is removed, the elastic force of the spring (5) is given to the pulley block (2), the piston rod (3) and the piston (4) then they are marched and a hydraulic pressure is decreased. Accordingly, while valve vane (11) of a cylinder (10) is opened, the gel-form lipstick materials saved in a dispenser body (12) are provided into the cylinder (10). Further, a piston (13) in the dispenser body (12) is marched corresponding to the discharging amount of lipstick materials.

In such lipstick dispenser, discharging of lipstick materials is only achieved depending on only the change of a hydraulic pressure of lipstick materials caused by movement of a piston. Accordingly, in case of gel-form lipstick materials with high viscosity, gel-form lipstick materials in dispenser body (12) are provided very slowly into the cylinder (10). In this case, the lipstick dispenser has a disadvantage in that it is not operated because gel-form lipstick materials are not provided yet despite of moving the pulley block (2) by way of pushing the pushing plate (1) again.

In addition to, another embodiment of conventional gel-form lipstick dispenser is shown in FIG. 2. It also has the same problems as the prior art in FIG. 1. In the conventional lipstick dispenser shown in FIG. 2, when a pushing part (22) is descended by pushing a pushing button (21), a pulley block (23), first and second cylinder (24, 25) are pushed toward a partition (26). Then a spring (27) is compressed and the pressure in a reservoir (28) is increased. Therefore, gel-form lipstick materials (29) are discharged toward a transferring tube (31) upon pushing a valve (30) in second cylinder (25), then, a toilet brush (32) is wet. At this time, a ratchet bar (33) is slightly advanced forwardly into a plate spring (34) and a first and a second piston (35, 36).

When the pushing part (22) is risen again by removing the force pressing the pushing button (21), the ratchet bar (33) is returned an original position by the restoring force of the spring (27). Also, saw-toothed projections **(33*a*) pull the plate spring (34) then the first and the second pistons (35, 36) are marched into the reservoir (28)** by the predetermined pitch.

However, although such gel-form lipstick dispenser is also used in gel-form lipstick materials with very low viscosity, it has a problem in that discharging is achieved not smoothly or slowly as to lipstick materials with high viscosity.

SUMMARY OF THE INVENTION

Therefore, the object of the present invention provides a lipstick dispenser having a new structure which can discharging excellently and safely not only liquid lipstick materials or gel-form lipstick materials with low viscosity but also gel-form lipstick materials with very high viscosity.

In order to achieve the object, the present invention provides a gel-form lipstick dispenser which may discharge gel-form lipstick materials safely, wherein a cylinder is displacement horizontally by being moved together with a pushing button provided in a dispenser body, and a first piston and a second piston are marched mechanically depending on a horizontal displacement of a ratchet bar coupled with the cylinder.

BRIEF DESCRIPTION OF THE DRAWINGS

FIG. 2 is a sectional view showing the gel-form lipstick dispenser according to another embodiment in prior art.

Figure 5A:
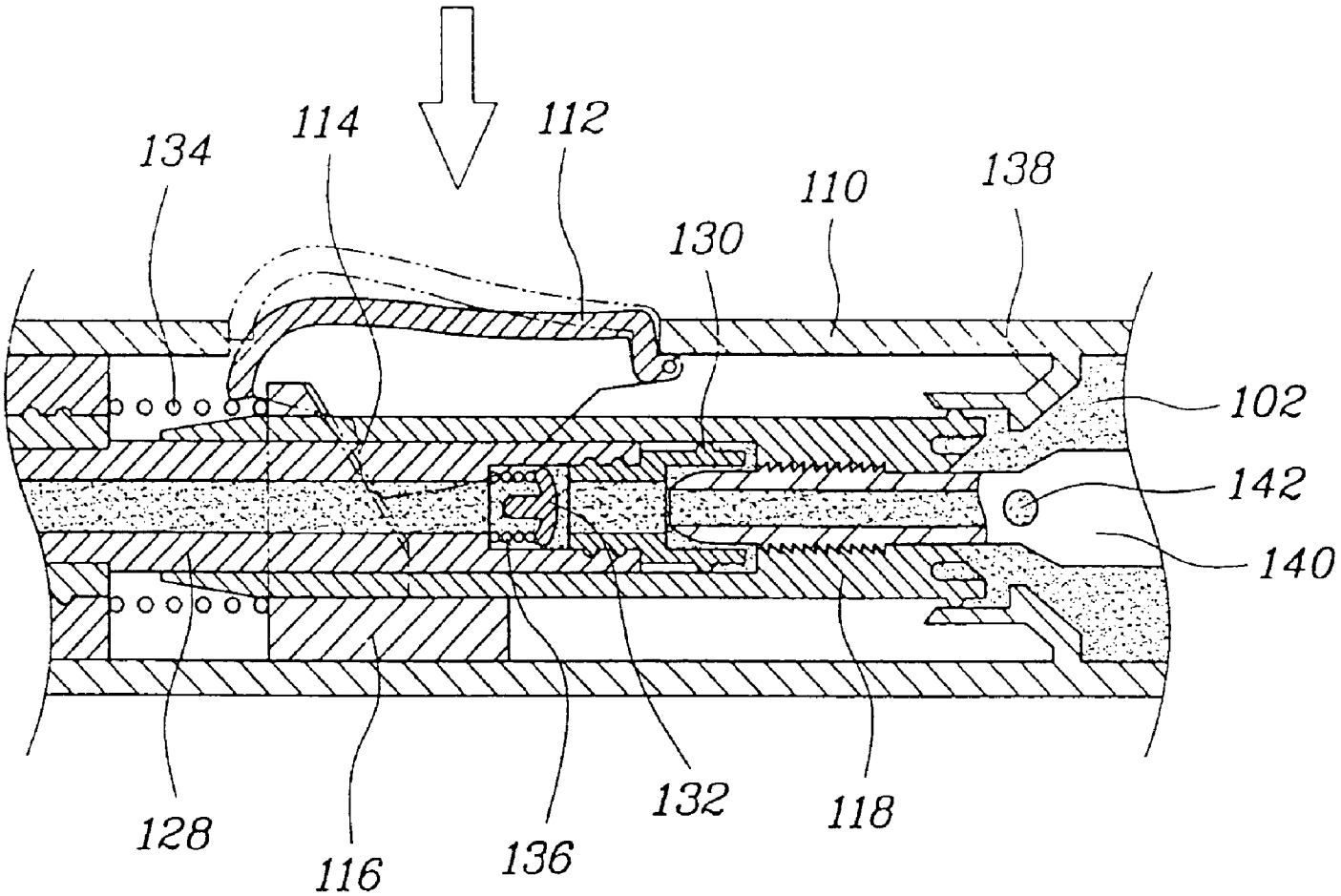
Figure 5B:
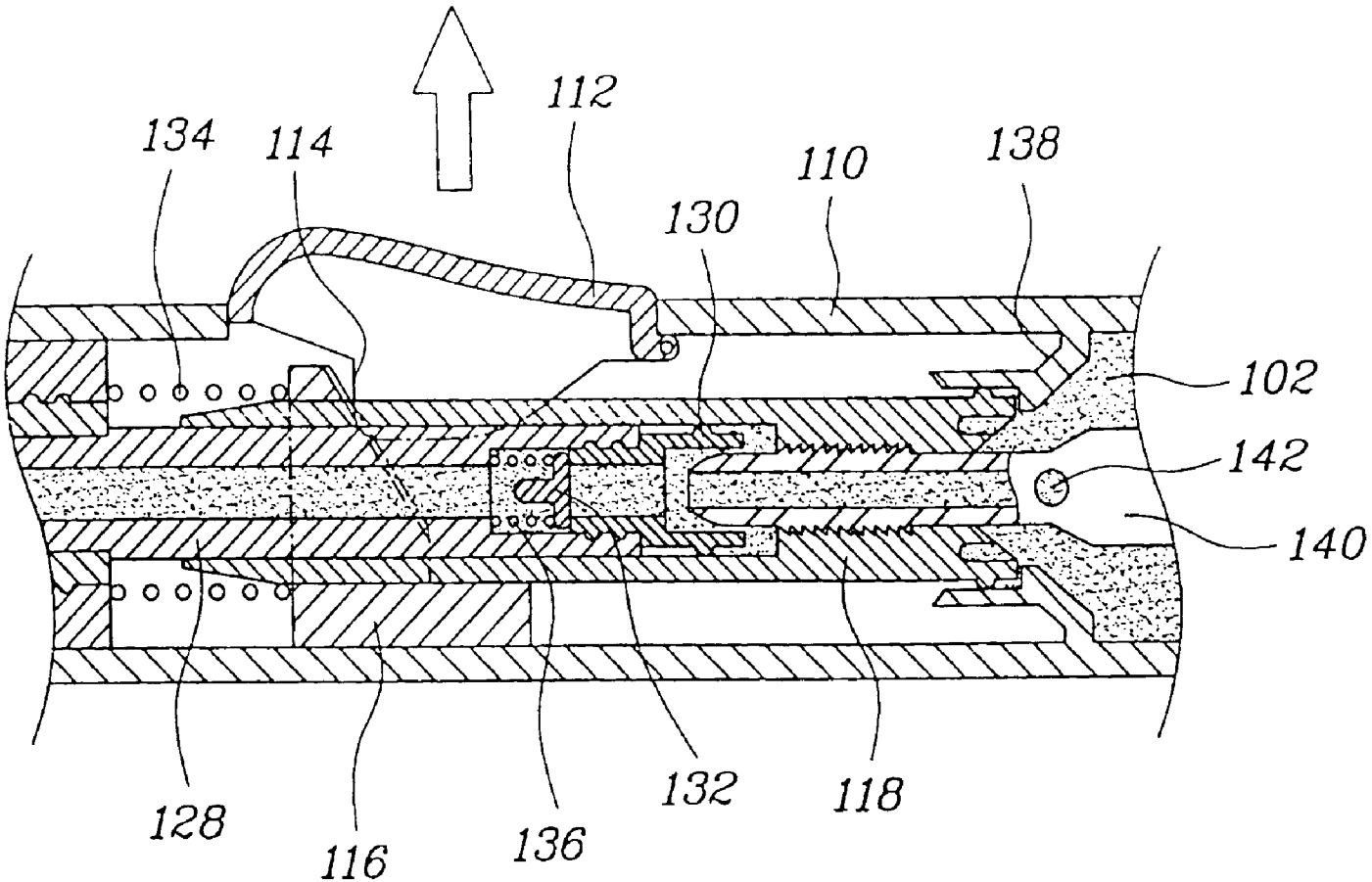

FIG. **5*a* and FIG. 5*b*** are sectional views showing the operating condition of the gel-form lipstick dispenser according to the present invention.

Figure 6A:
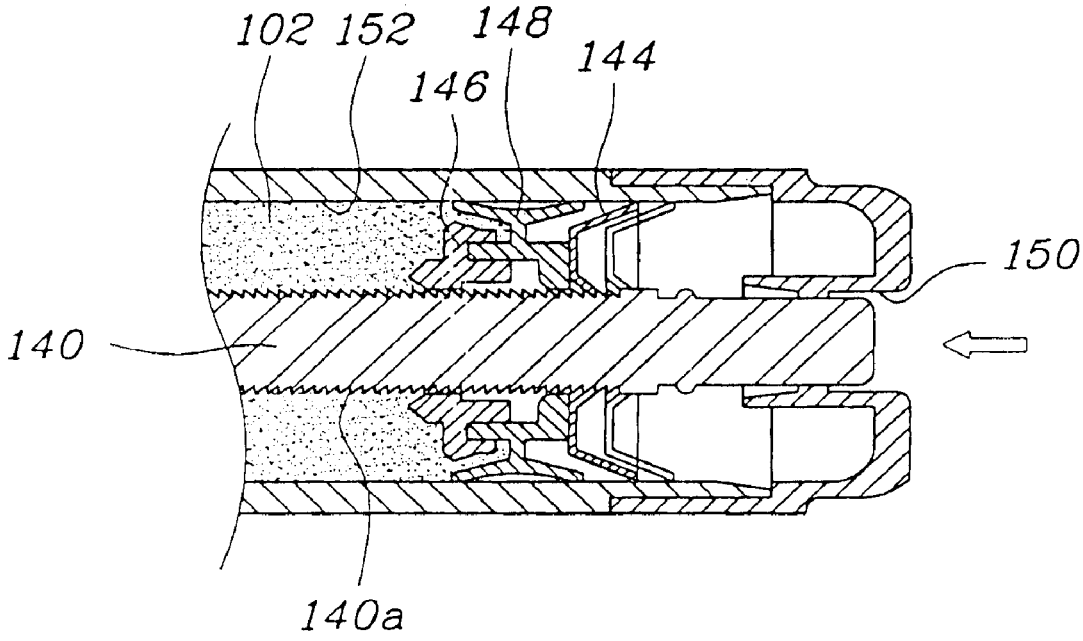
Figure 6B:
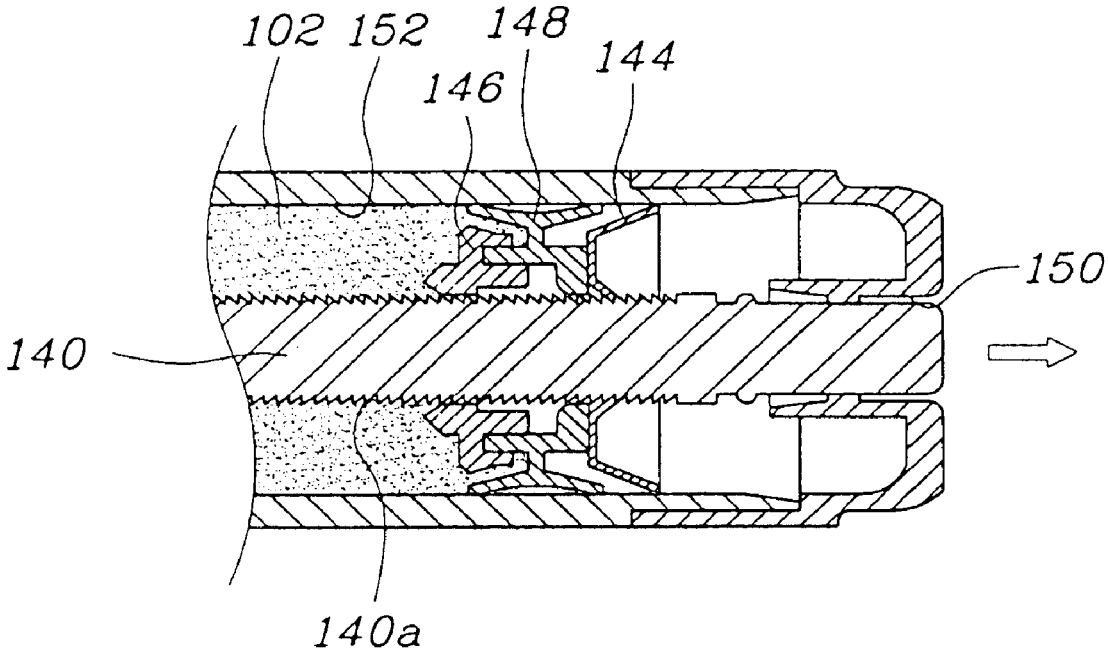

FIG. **6*a* and FIG. 6*b*** are sectional views showing the operation condition of a piston and a plate spring in the gel-form lipstick dispenser according to the present invention.

DETAILED DESCRIPTION OF THE PREFERRED EMBODIMENTS

Hereinafter, the preferred embodiment of the present invention is described in detail referring to the accompanying drawings.

Figure 1:
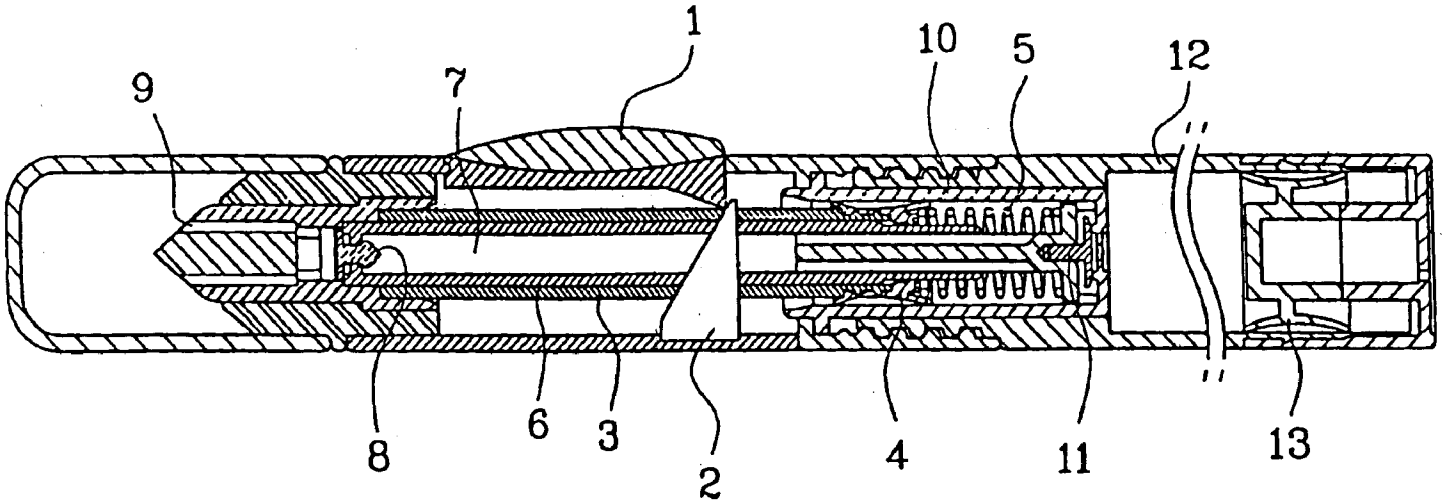
FIG. 1 is a sectional view showing the gel-form lipstick dispenser according to an embodiment in prior art.
Figure 3:
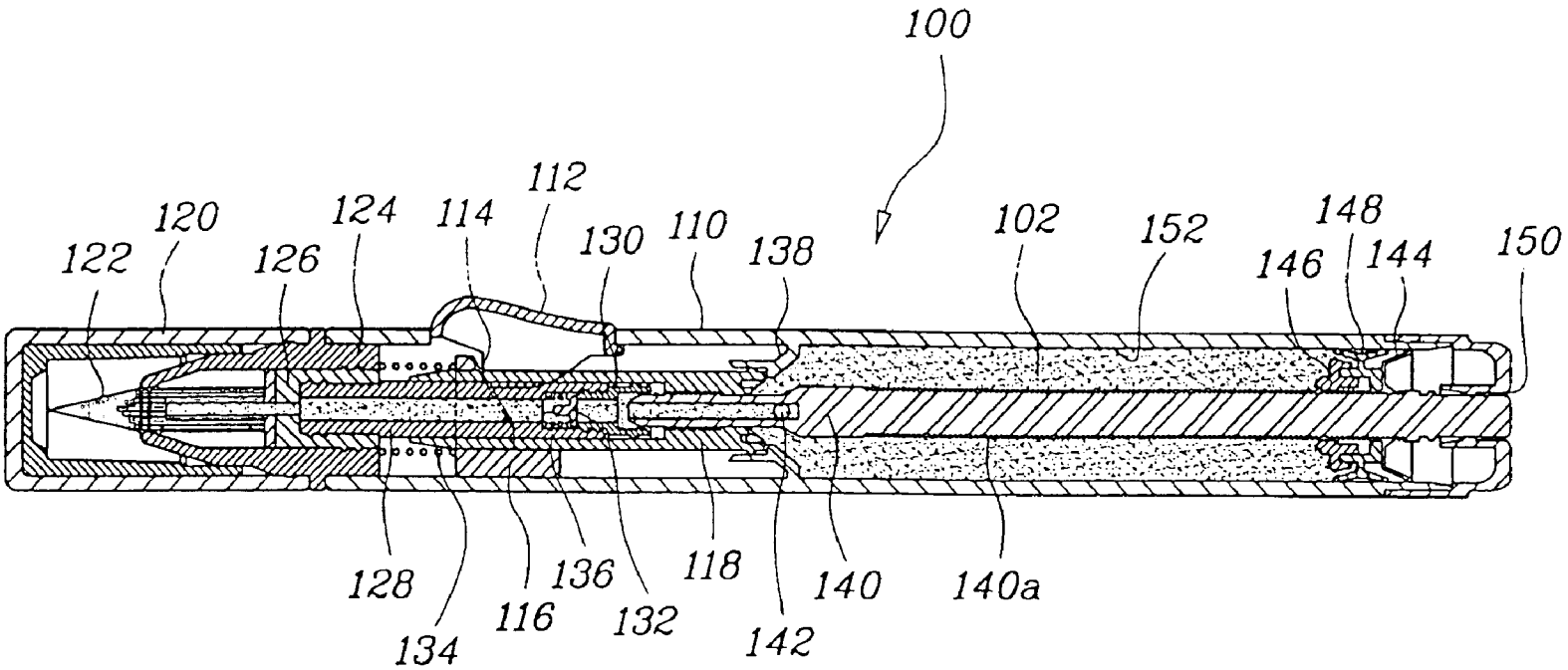
FIG. 3 is a sectional view showing the gel-form lipstick dispenser according to the present invention.
Figure 4:
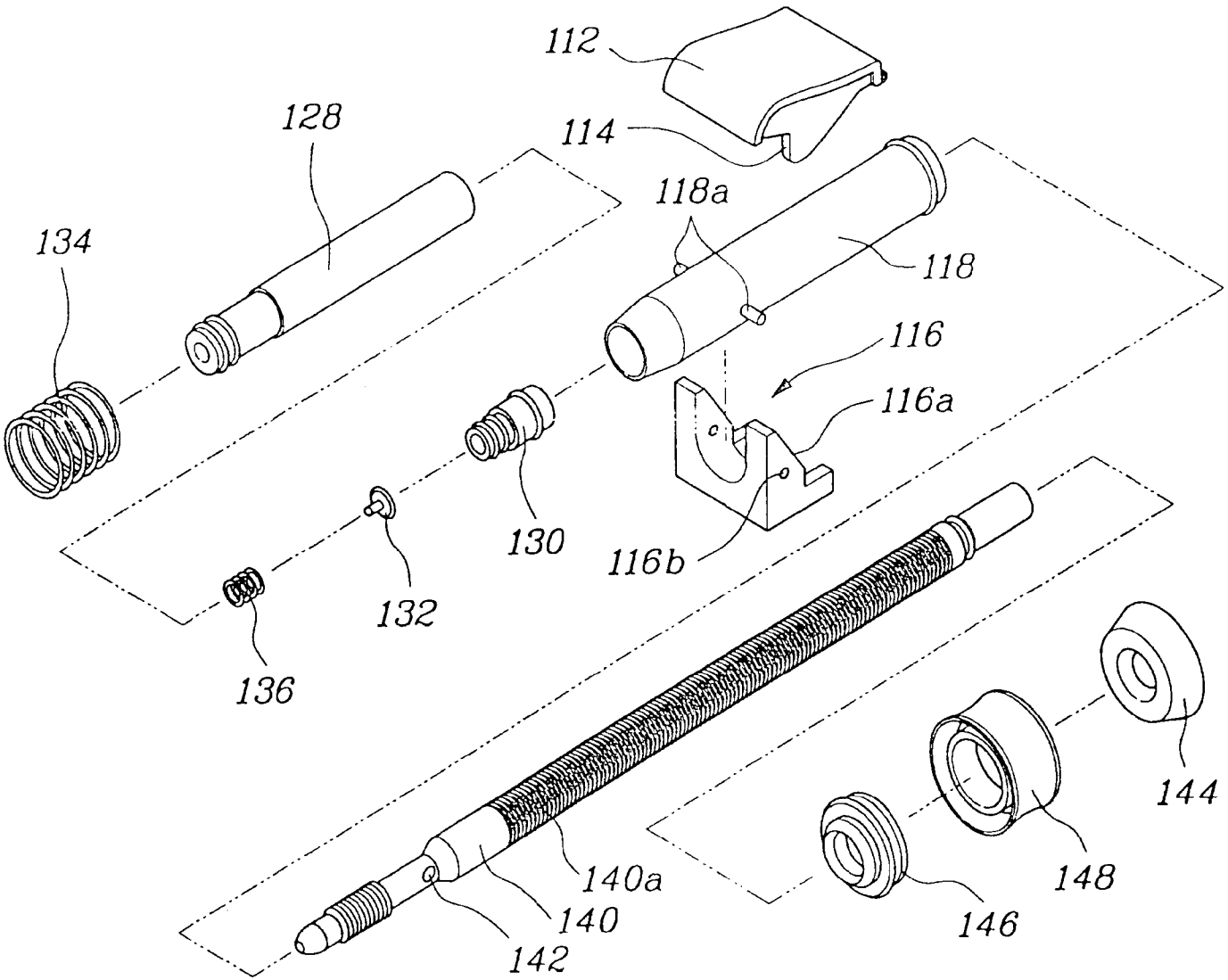
FIG. 4 is a disassembled schematic view showing the main parts of the gel-form lipstick dispenser according to the present invention.

FIG. 3 is a sectional view showing the gel-form lipstick dispenser according to the present invention and FIG. 4 is a disassembled schematic view showing the main parts of the gel-form lipstick dispenser according to the present invention.

As shown the Figs., the appearance of a lipstick dispenser (100) is composed of a dispenser body (110) and a cap (120). And a pushing button (112) is formed on the top of the dispenser body (110). On the front of the dispenser body (110) is a tip holder (124) coupled, and a toilet brush (122) is inserted into a tip holder (124) then a cap (120) is covered. A transferring holder (126) is interposed into the tip bolder (124), and a transferring tube (128) is interposed again into the transferring holder (126). Gel-form lipstick materials (102) discharging through the transferring tube (128) are provided to the toilet brush (122) after passing the transferring holder (126).

On the bottom of the pushing button (112) is a pushing plate (114) combined, and the pushing plate (114) is contacted to a declined surface (116*a*) of a pulley block (116) formed in interior of the dispenser body (110). The pulley block (116) is coupled with the cylinder (118), and it may slide going with inner wall of the dispenser body (110). A through-hole (116*b*) is formed on the both sides of the pulley block (116) and a protrusion (118*a*) is formed on the outer wall of cylinder (118) correspondingly. Therefore, the pulley block (116) and the cylinder (118) may be coupled each other by combining the through-hole (116*b*) and the protrusion (118*a*). The transferring tube (128) is inserted into the cylinder (118), and movement of the cylinder (118) in forward and backward going with the outer wall of the transferring tube (128) is possible by way of its moving together with the movement of the pulley block (116). A first spring (134) is interposed between the pulley block (116) and the tip holder (124). The valve holder (130) is combined to the rear end portion of the transferring tube (128), and the dispensing valve (132) is provided on the front end portion of the valve holder (130) in interior of the transferring tube (128). Between inner wall protrusion of the transferring tube (128) and the discharging valve (132) is a second spring (136) provided.

Further, a ratchet bar (140) is combined to the rear end portion of the cylinder (118), and the ratchet bar (140) is inserted into an inserting hole (150) of the ratchet bar formed on the rear end portion of the dispenser body (110) by being extended following to inside of the dispenser body (110). In a predetermined position of the dispenser body (110) is a partition (138) formed, and the partition (138) is contacted with the rear end portion of the cylinder (118). Therefore, a specific space in the dispenser body (110) becomes a reservoir (152) because the partition (138) is formed approximately on the middle of the inside of the dispenser body (110). Gel-form lipstick materials (102) are contained in the reservoir (152). On the front end portion of the ratchet bar (140) is a discharging opening (142) formed adjacent to the partition (138), and a saw-teeth (140*a*) having fine pitches are formed on the outer periphery of the ratchet bar (140). In the outer periphery of the ratchet bar (140) provided with the saw-teeth (140*a*) is the first piston (146) inserted, and the second piston (148) is contacted with the inner periphery of the dispenser body (110) in coupling to the first piston (146). In addition to, a plate spring (144) is interposed between the saw-teeth (140*a*) of the ratchet bar (140) and the inner wall of the dispenser body (110) and fixing coupled to the rear end portion of the second piston (148).

Subsequently, the operation of the lipstick dispenser (100) is explained. FIG. 5*a* and FIG. 5*b* are sectional views showing the operating condition of the gel-form lipstick dispenser (100) according to the present invention, and FIG. 6*a* and FIG. 6*b* are sectional views showing the operating condition of a piston and a plate spring in the gel-form lipstick dispenser according to the present invention. FIG. 5*a* and FIG. 5*b* illustrate the movement of the pushing plate (114), the pulley block (116), the cylinder (118), the ratchet bar (140), the discharging valve (132), the first spring (134) and the second spring (136) depending on the operation of the pushing button (112). Further, FIG. 6*a* and FIG. 6*b* illustrate the movement of the first piston (146), the second piston (148) and the plate spring (144) depending on the operation of the ratchet bar (140). Furthermore, FIG. 5*a* and FIG. 6*a* illustrate the operating condition when the pushing button (112) is pushed, and FIG. 5*b* and FIG. 6*b* illustrate the operative condition when the pushing button (112) is not pushed.

When the pushing button (112) is pushed, as shown in FIG. 5*a*, the pushing spring (114) presses the inclined surface (116*a*) of the pulley block (116). Hence, the pulley block (116) pushes the first spring (134) upon progressing toward the dispenser body (110). The cylinder (118) coupled to the pulley block (116) is also advanced depending on the movement of the pulley block (116) and the ratchet bar (140) is also moved in the valve holder (130). Therefore, lipstick materials flow in the valve holder (130) through the discharging opening (142) upon increasing of the interior pressure in the reservoir (152), and they are discharged toward the transferring tube (128) upon opening of the dispensing valve (132). Although not shown in Figs., the lipstick materials (102) discharged toward the transferring tube (128) are provided to the toilet brush (122). When the ratchet bar (140) is advanced by pushing the pushing button (112), as shown in FIG. 6*a*, the first piston (146), the second piston (148) and the plate spring (144) interposed the ratchet bar (140) are marched.

Subsequently, when the pushing button (112) is raised again by removing the force pressing the pushing button (112), as shown in FIG. 5*b*, the pulley block (116) is thrust and retracted on the original position by the restoring force of the first spring (134). Therefore, the cylinder (118) coupled to the pulley block (116) and the ratchet bar (140) are retracted together, and the discharging valve (132) is also closed to the valve holder (130) by the restoring force of the second spring (136). As shown FIG. 6*b*, when the ratchet bar (140) is retracted in backward, the first piston (146), the second piston (148) and the plate spring (144) interposed in the ratchet bar (140) are not retracted following to the ratchet bar (140) but stayed on the position where they are progressed. This is because the saw-teeth (140*a*) of the ratchet bar (140) are inclined in backward and the plate spring (144) being in gear with the saw-teeth (140*a*) of the ratchet bar (140) is bent corresponding to the saw-teeth (140*a*) shape. That is, when the ratchet bar (140) is progressed, the plate spring (144) is marched by being in gear with the saw-teeth (140*a*) of the ratchet bar (140). However, when the ratchet bar (140) is retracted, the outer surface of the plate spring (144) is caught to the inner wall of the dispenser body (110). Further, the ratchet bar (140) is marched into the plate spring (144) of the ratchet bar (140) while the inner surface of the plate spring (144) is sliding on the inclined surface of the saw-teeth (140*a*). Accordingly, the volume in the reservoir (152) is decreased corresponding to the advancement of the plate spring (144) and the first and the second springs (146, 148). In other words, when the pushing button (112) is operated repeatedly, that is, lipstick materials (102) are discharged continuously, the plate spring (144), the first spring (146) and the second spring (148) are advanced gradually following to the saw-teeth (140*a*) of the ratchet bar (140) by the predetermined pitch.

As above-described, a gel-form lipstick dispenser according to the present invention has an advantage in that a cylinder is forcibly displaced horizontally and the first and the second pistons are forcibly marched rely on a horizontal displacement of a ratchet bar caught with the cylinder so that even lipstick materials with high viscosity are discharged excellently and safely and all lipstick materials contained in the dispenser being able to be used.

What is claimed is:

1. A gel-form lipstick dispenser (100) comprising a pushing button (112) formed on the top of a dispenser body (110); a tip holder (124) coupled to the front of said dispenser body (124) and interposing a toilet brush (122); and a transferring tube (128) provided in said tip holder (124) wherein gel-form lipstick materials (102) are furnished to said toilet brush (122) through said transferring tube (128), in which a pushing plate (114) is coupled on the bottom of said pushing button (112), said pushing plate (114) is contacted with an inclined surface (116*a*) of a pulley block (116) formed in said dispenser body (110); said pulley block (116) is coupled to a cylinder (118) then slides following to the inner wall of said dispenser body (110); said transferring tube (128) is inserted into said cylinder (118); said cylinder (118) is moved together with movement of said pulley block (116) then moved in forward and in backward following to the outer wall of said transferring tube (128); a first spring (134) is interposed between said pulley block (116) and said tip holder (124); a valve holder (130) is coupled to the rear end portion of said transferring tube (128); a discharging valve (132) is installed on the front end portion of said valve holder (130); and a second spring (136) is provided between said transferring tube (128) and said discharging valve (132); and in which a ratchet bar (140) is coupled on the rear end part of said cylinder (118); said ratchet bar (140) is interposed into a inserting hole (150) of the ratchet bar formed on the rear part of said dispenser body (110); a partition (138) is formed on the inner wall of said dispenser body (110) then a reservoir (152) is formed; saw-teeth (140*a*) are formed on the outer periphery of said ratchet bar (140) then a first piston (146) is inserted; a second piston (148) is coupled with said first piston (146) then contacted to the inner periphery of said dispenser body (110); and a plate spring (144) is interposed between saw-teeth (140*a*) of said ratchet bar (140) and the inner wall of said dispenser body (110) then coupled to the rear end portion of said second piston (148).

* * * * *